United States Patent [19]

Goldenhersh

[11] Patent Number: 4,861,651

[45] Date of Patent: Aug. 29, 1989

[54] ULTRAVIOLET BLOCKING MATERIAL AND METHOD OF MAKING SAME

[76] Inventor: Michael A. Goldenhersh, 203 Bluff Rd., Belleville, Ill. 62223

[21] Appl. No.: 201,594

[22] Filed: Jun. 2, 1988

[51] Int. Cl.[4] ..... B32B 7/00

[52] U.S. Cl. ..... 428/255; 428/260; 428/289; 428/913; 427/160; 427/245

[58] Field of Search ..... 427/160, 245; 428/131, 428/255, 260, 269, 289, 913

[56] References Cited

U.S. PATENT DOCUMENTS

| | | | |
|---|---|---|---|
| 3,004,896 | 10/1961 | Heiler et al. | 514/150 |
| 3,441,063 | 7/1967 | Press et al. | 139/391 |
| 4,344,930 | 8/1982 | MacRae et al. | 514/182 |
| 4,546,493 | 10/1985 | Bortnick | 428/229 |

*Primary Examiner*—James J. Bell

*Attorney, Agent, or Firm*—Amster, Rothstein & Ebenstein

[57] ABSTRACT

An ultraviolet blocking material comprises a breathable fabric defining porosity-creating apertures and a coating on the fabric at least partially disposed in the apertures. The coating contains an effective amount of at least one UV blocker.

24 Claims, 1 Drawing Sheet

ULTRAVIOLET BLOCKING MATERIAL AND METHOD OF MAKING SAME

BACKGROUND OF THE INVENTION

The present invention relates to an ultraviolet blocking material, and more particularly to a breathable ultraviolet blocking material.

Ultraviolet radiation is to be credited with certain therapeutic applications—for example, the treatment of psoriasis—but is far better known for its harmful effect on skin ranging from the simple sunburn to a dried-out, prematurely wrinkled skin, cataracts, and skin cancer. While the present application is concerned particularly with the protection of human beings from the delterious effects of ultraviolet radiation, such effects extend beyond humans and encompass other animals, food stuffs, medicines, upholstery and the like.

Ultraviolet radiation refers to that portion of the spectrum just beyond the violet on the short-wavelength side, generally 200–400 nm. At least with respect to human skin, the most pertinent portions of the spectrum are considered to be UVA radiation (about 320–400 nm) and UVB radiation (about 290–320 nm). Topical sunscreens contain absorber chemicals which can be applied directly to the skin to block transmission of at least some UV radiation, for example, by absorbing it. The topical sunscreens have not proven to be entirely satisfactory in use, however. They are typically inconvenient to apply, expensive, require frequent re-application, may cause photosensitivity reactions, allergic contact dermatitis or acne cosmetica, may stain clothing yellow and provide only a relatively low level of UVA protection.

Untreated yarn may itself block the transmission of ultraviolet radiation and, if it does not, can frequently be treated to provide such a function. Thus, tightly knit or double knit clothing may be used to protect against ultraviolet radiation, but such clothing is clearly uncomfortable to wear in warm weather, precisely when the need for sun protection is greatest. Indeed, UV blockers have been incorporated into textile fibers (such as wool) to protect them from the deleterious effects thereon of ultraviolet radiation. In such instances, however, it is the fibers of the fabric—or the added UV blocker deposited on the fibers—which provide protection against UV transmission and thus a dense material, such as a double knit, closely woven, or woven of densely intermeshed fibers, must be employed. For example, if the fibers of the fabric are only loosely intermeshed or if the interstices defined by the threads of a woven fabric are large, ultraviolet radiation which might otherwise be stopped by the fibers can pass through the apertures to reach the wearer unless the fabric is layered. See *Acta. Derm. Venereol.* (1980), Vol. 60, pp. 459–460, B. Berne et al., "Protective Effects of Various Types of Clothes Against UV Radiation"; *Clin. Exp. Dermatol.* (1981) Vol. 6, pp. 577–582, esp. p. 581, C. Welsh et al., "The Protection Against Solar Actinic Radiation Afforded By Common Clothing Fabrics"; *Arch. Dermotol.* (1985), Vol. 121, pp. 1400–1402; *Dermotologic Clinics* (1986), Vol. 4, No. 2, pp. 321–334, esp. p. 331, M. Pathak, "Sunscreens"; Japanese Patent No. 59,179,878 (underwear fabric containing UV absorber). Such a dense material or layered clothing makes the wearer warm and is thus not acceptable for wear at the beach and other places most requiring UV sunscreen protection. Thus, the need remains for a material which combines the ability to afford the wearer a high degree of ultraviolet radiation protection with breathability (that is, moisture vapor permeability) and porosity.

Accordingly, it is an object of the present invention to provide an ultraviolet blocking material which is based on a breathable fabric of loosely intermeshed fibers.

Another object is to provide such a material which is based on a breathable fabric defining porosity-creating apertures and yet provides ultraviolet blocking even in the apertures.

A further object is to provide such a material which, if desired, is breathable.

It is also an object to provide such a material which is lightweight, inexpensive, comfortable to wear and easy to maintain.

SUMMARY OF THE INVENTION

It has now been found that the above and related objects of the present invention are attained in an ultraviolet blocking material comprising a breathable fabric defining porosity-creating apertures, and a coating on the fabric at least partially disposed in the apertures. The coating contains an effective amount of at least one UV blocker.

In a preferred embodiment, the fabric comprises a web of loosely intermeshed fibers defining interstices therebetween, the coating being at least partially disposed within the interstices. The fabric may be a woven material with the web comprising loosely woven threads defining the interstices therebetween. The coating is breathable (i.e., moisture vapor permeable) and biaxially spans the apertures. The coating contains a total of at least 5% of UV blocker on a dry weight basis, preferably about 7%, with the UV blocker being p-aminobenzoic acid or oxybenzone. The material is characterized by a zero percent transmittance of both UVA and UVB under a UVA irradiance of 4.5 $mW/cm^2$ and a UVB irradiance of 1.6 $mW/cm^2$.

The invention further encompasses clothing made at least in part of the material and a method of making the material by applying a moist coating to the fabric to at least partially fill the apertures therewith, and then drying the coating on the fabric.

BRIEF DESCRIPTION OF THE DRAWING

The above brief description, as well as further objects and features of the present invention, will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
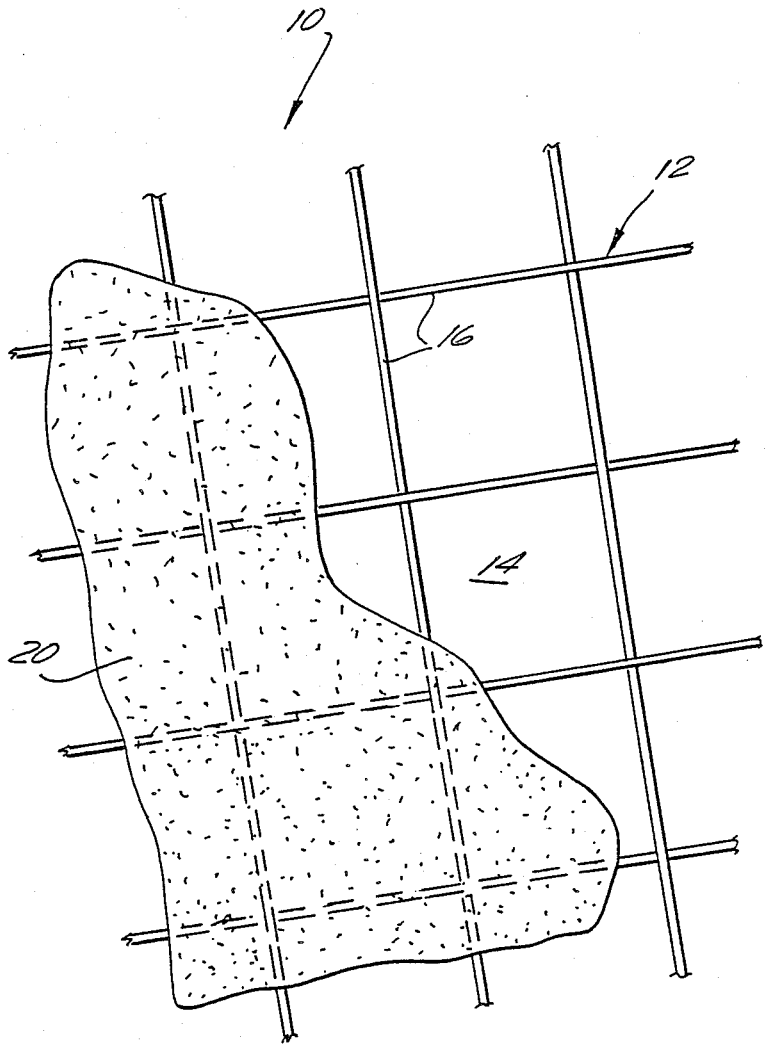
FIG. 1 is a top plan view of the ultraviolet blocking material of the present invention.

Referring now to the drawing, therein illustrated is an ultraviolet blocking material according to the present invention, generally designated by the reference numeral 10. The material 10 may be used for clothing, both outdoor clothing (e.g., hats, beach wear, stockings, T-shirts, etc.) and indoor clothing (e.g., as industrial clothing for ultraviolet contaminated environments), as well as window shades, parasols, umbrellas, tents and the like. While the preferred embodiments of the present invention discussed herein are primarily intended for use as clothing, clearly the principles of the present invention apply equally well to materials intended for other applications.

The ultraviolet blocking material 10 includes, as a substrate, a fabric 12. In order to prevent an accumulation of moisture within the region covered or encircled by the fabric, the fabric 12 is breathable (that is, water vapor-permeable). Additionally, the fabric 12 defines apertures or interyarn spaces 14 which afford porosity to the fabric. The porosity created by the apertures 14 may be the source of the breathability of the fabric 12. Alternatively, the breathability may result from the other factors well recognized in the art. More particularly, the fabric 12 comprises a web of loosely intermeshed fibers 16 defining interstices 14 therebetween, the loosely intermeshed fibers of the web being loosely woven threads or yarns defining the interstices therebetween in the case of a woven. The fabric itself may be formed of natural or synthetic materials, including cotton, wool, velvet, denim, polyester, and nylon, to name only a few of the multitude of fabrics currently available on the market in a breathable apertured form. For reasons which will become apparent hereinafter, the fabric 12 need not, by itself, be in any way an ultraviolet blocker.

A coating 20 is on the fabric 12, at least partially disposed in the apertures or interyarn spaces 14. The composition of the coating 20 is, of course, selected for compatability with the composition of the fabric 12 from any of the wide range of natural and synthetic coatings available, including polyvinyl chloride, neoprene, natural and synthetic rubbers, acrylics, polyurethanes, silicones, etc.

The composition of the coating is also selected for its coating properties. The coating may be applied, to one or both of the fabric substrate surfaces, by any of the techniques well recognized in the coating art as depositing a coating within the apertures or interstices 14. See, for example, *Textile* (Spring 1985), Vol. 14, No. 1, pp. 2–8. More particularly, the coating composition 20, when dried, should span from one side of an aperture or interstice 14 to the other along two orthogonal axes in the plane of the fabric; in other words, the coating 20 should "fill" the aperture lengthwise and widthwise, even if not depthwise. While for economic reasons it is preferred that the coating 20 occupy the interstice 14 to a uniform depth, this is not essential so long as the coating occupies the interstice to a depth which exceeds some critical minimum necessary to afford the appropriate uniform minimum level of ultraviolet blocking to the material for a given application.

Where breathability of the coating is of concern, the coating may be made porous, microporous, breathable poromeric, breathable non-poromeric, etc. according to techniques well known in the art in order to provide breathability. See *Knitting International* (August 1985), Vol. 92, pp. 115–116. The method by which the coating composition 20 is applied to the fabric 12 will depend upon various factors such as the fabric composition and nature, the coating composition, the level of breathability desired in the composition, the available equipment and the like. Depending upon such factors, the coating composition may initially be directly applied (sprayed, painted, dipped, applied with a doctoring blade or knife edge, etc.) or indirectly applied (for example, as a preformed film). Indeed, the degree of looseness acceptable in the fabric 12—that is, the upper limit on the size of the apertures 14—is limited only by the ability of the coating composition 20 to fill in the apertures. Within limits the viscosity of the coating composition may be varied to provide suitable filling of the fabric apertures 14 by the coating composition 20.

The coating 20 may comprise a single uniform coating extending over substantially the entire surface of the fabric including both the fibers 16 and the apertures 14, or may comprise a plurality of discrete coatings filling the apertures 14 and being bounded by, for example, the threads 16 of a woven fabric. Where the fabric itself (without the coating) provides UV blockage comparable to that provided by the coating within an aperture, it is only necessary for the coating to extend over the fabric portion in order to meet other considerations such as uniformity of feel, maintenance of the discrete coatings within the apertures, and the like. On the other hand, where the fabric portion does not provide comparable protection against UV radiation, the coating should extend over the fabric portion as well, to a depth sufficient to provide, in conjunction with the fabric portion, the minimum acceptable UV blockage.

Inasmuch as breathable fabrics defining porosity-creating apertures are well known in the fabric art and such fabrics containing coatings (whether breathable or not) at least partially disposed in the apertures are also well known in the coating and fabric arts, these conventional aspects of the present invention do not require further elucidation herein. Those skilled in the coated fabric art will readily appreciate which fabrics and coatings may be used together and how a given coating may be applied to a given fabric in order to produce a coated fabric having the desired properties, including the desired level of breathability and apertures, or be able to easily determine the same with a modest amount of routine experimentation.

The coating composition 20 contains an effective amount of a UV blocker. Any of the presently known or hereinafter discovered UV blockers (and this includes materials which absorb, block or reflect UV) may be utilized such as p-aninobenzoic acid (PABA) and its esters, benzophenones such as oxybenzone, cinnamates, anthranilates, salicylates, and camphor derivatives. Especially preferred are PABA and oxybenzone. The selection of the particular UV blocker for a particular application will be affected by such considerations as its compatability with the coating and fabric compositions, its cost, the range of UV radiation expected to be encountered, and the like. If necessary, combinations of UV blockers may be used for either additive or synergistic effects or to provide blockage effective over particular ranges of the spectrum. While the blocker is not being applied directly to the skin, as in a topical sunscreen, where the material will be utilized to form clothing, the blocker may eventually be adjacent skin and hence should be selected for its non-reactive nature.

It will be appreciated that the coating, absent the blocker, need play no role itself in blocking ultraviolet radiation. On the other hand, particular coatings will, even absent the blocker, contribute to some degree to that effect, and such contributions should be taken into account in determining the amount of blocker to use in the coating. Otherwise, however, the coating composition merely serves as the vehicle for introducing the blocker into, and maintaining it within, the apertures of the fabric. Accordingly, the level at which the coating is applied to the fabric will vary greatly with the level of the blocker in the coating, both of these in turn varying widely with the intended application of the coated fabric. Generally the level of a blocker such as oxybenzophenone should be at least 5% of the coating, on a dry weight basis, and preferably about 7%, to block all UVA and UVB transmittance. To insure proper mixing of the coating 20 and blocker, the blocker may be premixed with an appropriate solvent (e.g., toluene, MEK, etc.) to form a solution of appropriate concentration prior to being mixed with the other ingredients of the coating composition.

EXAMPLE

In order to prepare the ultraviolet blocking material of the present invention, oxybenzone (from Aldrich Chemical Company of New York) was diluted with toluene and mixed into a clear Durane #7801 coating at a solids content of 30% by weight (a polyurethane available from Raffi and Swanson, Inc. of Wilmington, Mass.), so that the coating contained about 7% oxybenzone, on a dry weight basis. The oxybenzone-containing coating was then evenly distributed at room temperature on one side only of a loosely woven Ninon fabric using a doctoring blade. The coating level on the fabric was 0.0254 gm/inch$^2$. The coated fabric was then oven-dried to evaporate the solvents and allow the coating solids to dry.

In order to determine the degree of protection provided by the ultraviolet blocking material thus formed, and in particular the contribution thereto of the UV absorber, specimens of the material were tested against controls consisting of the same fabric without any coating and the same fabric with a coating not containing the oxybenzone (the level of the coating without the oxybenzone being about 0.0226 gm/inch$^2$). A Brandt sunlamp (available from Sperti) was used as the ultraviolet source. Samples of the fabric were tested by passing ultraviolet radiation through one side of the fabric and measuring the output of UVA (approximately 3650 A wavelength) and UVB (approximately 3000 A wavelength) radiation from the other side. A Spectroline DRC-100H Digital Radiometer was used as the ultraviolet sensor. The results are indicated in the Table below, along with the calculated % transmittance for UVA and UVB. As the measured unimpeded ultraviolet radiation from the sunlamp varied with slight changes in the distance between the UV source and UV sensor, the unimpeded radiation measurement (i.e., without the material, fabric, or coating) is provided as the denominator for each impeded radiation measurement.

The Table indicates that even the uncoated loosely woven fabric reduced the UVA and UVB radiation substantially (about $\frac{1}{3}$), and that the fabric with a coating not containing any ultraviolet blocker further reduced transmittance only very modestly in the case of the UVA, while more substantially in the case of UVB (by about half). By way of contrast, where the coating contained an ultraviolet blocker, the transmittance level for both UVA and UVB was reduced to zero. The ability of the ultraviolet blocking material to eliminate transmittance of both UVA and UVB radiation was unexpected in view of the fact that the UVA sunscreen chemicals applied topically generally provide a blockage of only about 30–50% of UVA and oxybenzone applied topically is a weak UVB blocker. The theoretical basis for the enhanced results obtained with the ultraviolet blocking material of the present invention is not fully understood.

The non-topical use of the UV blocker permits its use at higher concentrations than would be suitable for topical use, and the maintenance of the UV blocker within the coating protects it from the dilution and impurities which typically result with topical application thereof.

The ultraviolet blocking material of the present invention finds particular utility for parasols, deck covers, beach umbrellas, tents and the like where ultraviolet blocking is required in combination with the transmission of visible light. For such applications, the coating is selected for its light transmittance property as well as for its UV blocking property, so that the visible light which would normally pass through the apertures of the uncoated fabric can also pass through the coating disposed in the apertures of the coated fabric. The UV blocking material of the Example was substantially transparent or translucent to visible light.

The ultraviolet blocking material of the present invention also finds particular utility for clothing, parasols, deck covers, beach umbrellas, tents and the like where ultraviolet blocking is required in combination with the blocking of heat-producing inisible infrared (IR) light. For such applications, the coating is selected for its IR blocking property as well as its UV blocking property, so that the IR light which would normally pass thorugh the apertures of the uncoated fabric are blocked by the coating disposed in the apertures of the coated fabric.

If desired, the coating may be formulated to provide desired combinations of these properties—for example, to block both UV and IR light while transmitting visible light.

To summarize, the present invention provides an ultraviolet blocking material which is based on a breathable fabric of loosely intermeshed fibers. The breathable fabric defines porosity-creating apertures and yet provides ultraviolet blocking even in the apertures. The material is light weight, inexpensive, comfortable to wear and easy to maintain. If desired, the material itself may be breathable.

Now that the preferred embodiments of the present invention have been shown and described in detail, various modifications and improvements thereon will become readily apparent to those skilled in the art. Accordingly, the appended claims should be construed broadly in a manner consistent with the spirit and scope of the invention herein.

TABLE

| TEST MATERIAL | IRRADIANCE (mW/cm$^2$) (impeded/unimpeded) UVA | UVB | % TRANSMITTANCE OF UVR UVA | UVB |
|---|---|---|---|---|
| Ninon Fabric (No Coating) | 3.1/4.5 | 1.1/1.8 | 69 | 61 |
| Ninon Fabric + #7801 Coating | 3.0/5.0 | 0.6/1.7 | 60 | 35 |
| Ninon Fabric + 7% Oxybenzone in #7801 Coating | 0/4.5 | 0/1.6 | 0 | 0 |

I claim:

1. An ultraviolet blocking material comprising:

(A) a breathable fabric defining porosity-creating apertures; and (B) a coating on said fabric at least partially disposed in said apertures, said coating containing an effective amount of at least one UV blocker.

2. The material of claim 1 wherein said fabric comprises a web of loosely intermeshed fibers defining interstices therebetween, said coating being at least partially disposed within said interstices.

3. The material in claim 2 wherein said web comprises loosely woven threads defining said interstices therebetween.

4. The material of claim 1 wherein said coating is breathable.

5. The material of claim 1 wherein said coating biaxially spans said apertures.

6. The material of claim 2 wherein said coating biaxially spans said interstices.

7. The material of claim 1 wherein said UV blocker is p-aminobenzoic acid.

8. The material of claim 1 wherein said UV blocker is oxybenzone.

9. The material of claim 1 characterized by a zero percent transmittance of both UVA and UVB under a UVA irradiance of 4.5 $mW/cm^2$ and a UVB irradiance of 1.6 $mW/cm^2$.

10. The material of claim 1 wherein said coating contains a total of about 7% of said UV blockers, on a dry weight basis.

11. The material of claim 2 wherein said coating transmits visible light.

12. The material of claim 1 wherein said coating blocks infrared light.

13. Clothing made at least in part of the material of claim 1.

14. Clothing made at least in part of the material of claim 3.

15. Clothing made at least in part of the material of claim 4.

16. Clothing made at least in part of the material of claim 11.

17. The material of claim 1 wherein said coating transmits visible light.

18. The material of claim 1 wherein said coating is breathable and transmits visible light.

19. The material of claim 1 wherein said coating fully occupies a cross section of each of said apertures.

20. A method of making an ultraviolet blocking material comprising the steps of:

(A) providing a breathable fabric defining porosity-creating apertures;

(B) applying a moist coating to the fabric to at least partially fill the apertures therewith, the coating containing an effective amount of at least one UV blocker; and (C) drying the coating on the fabric.

21. The method of claim 20 wherein the coating is breathable.

22. The method of claim 20 wherein the coating transmits visible light.

23. The method of claim 20 wherein the ultraviolet blocking material is breathable and the moist coating applied to the breathable fabric is breathable when dried.

24. The method of claim 20 wherein said moist coating is applied to the fabric so as to fully occupy a cross section of each of the apertures therein.

* * * * *